United States Patent [19]

Maeda et al.

[11] Patent Number: 4,765,159

[45] Date of Patent: Aug. 23, 1988

[54] CONTROLLER FOR A DRY CLEANING APPARATUS

[75] Inventors: Akira Maeda; Haruo Hagiwara, both of Nagoya, Japan

[73] Assignee: Mitsubishi Jukogyo Kabushiki Kaisha, Tokyo, Japan

[21] Appl. No.: 72,214

[22] Filed: Jul. 10, 1987

[30] Foreign Application Priority Data

Jul. 17, 1986 [JP] Japan ..... 61-168838

[51] Int. Cl.[4] ..... D06F 43/02; D06F 33/02

[52] U.S. Cl. ..... 68/12 R; 68/18 F

[58] Field of Search ..... 68/12 R, 18 R, 18 F

[56] References Cited

U.S. PATENT DOCUMENTS

| | | | |
|---|---|---|---|
| 2,438,252 | 3/1948 | Richardson | 203/87 |
| 2,759,346 | 8/1956 | Beduhn | 68/18 F |
| 2,979,375 | 4/1961 | Kircher, Jr. et al. | 68/18 R X |
| 3,826,113 | 7/1974 | Noraas et al. | 68/12 R |
| 4,335,591 | 6/1982 | Gillespie | 68/12 R |
| 4,404,625 | 9/1983 | Saito et al. | 68/12 R X |
| 4,444,625 | 4/1984 | Smith | 203/95 |
| 4,449,384 | 5/1984 | Jones | 68/12 R |
| 4,503,575 | 3/1985 | Knoop et al. | 68/12 R X |
| 4,712,392 | 12/1987 | Hagiwara et al. | 68/12 F X |

FOREIGN PATENT DOCUMENTS

| | | | |
|---|---|---|---|
| 17516 | 10/1980 | European Pat. Off. | 68/12 R |
| 2812666 | 10/1978 | Fed. Rep. of Germany . | |
| 3436786 | 4/1986 | Fed. Rep. of Germany | 68/12 R |

*Primary Examiner*—Philip R. Coe

[57] ABSTRACT

A dry cleaning apparatus includes one processing tank, tanks capable of exclusively containing two or more types of solvents, respectively, capable of melting to be mixed with each other, a fractionating device for fractionating the two or more types of solvents and filters for respective solvents. A controller for the dry cleaning apparatus includes a central processor unit formed of an electronic circuit which is a center of control and washing programs for washing with a single solvent and combined solvents, the program being stored in the central processor unit. Accordingly, an optimum washing method can be selected in accordance with material, processing and form of clothes.

1 Claim, 20 Drawing Sheets

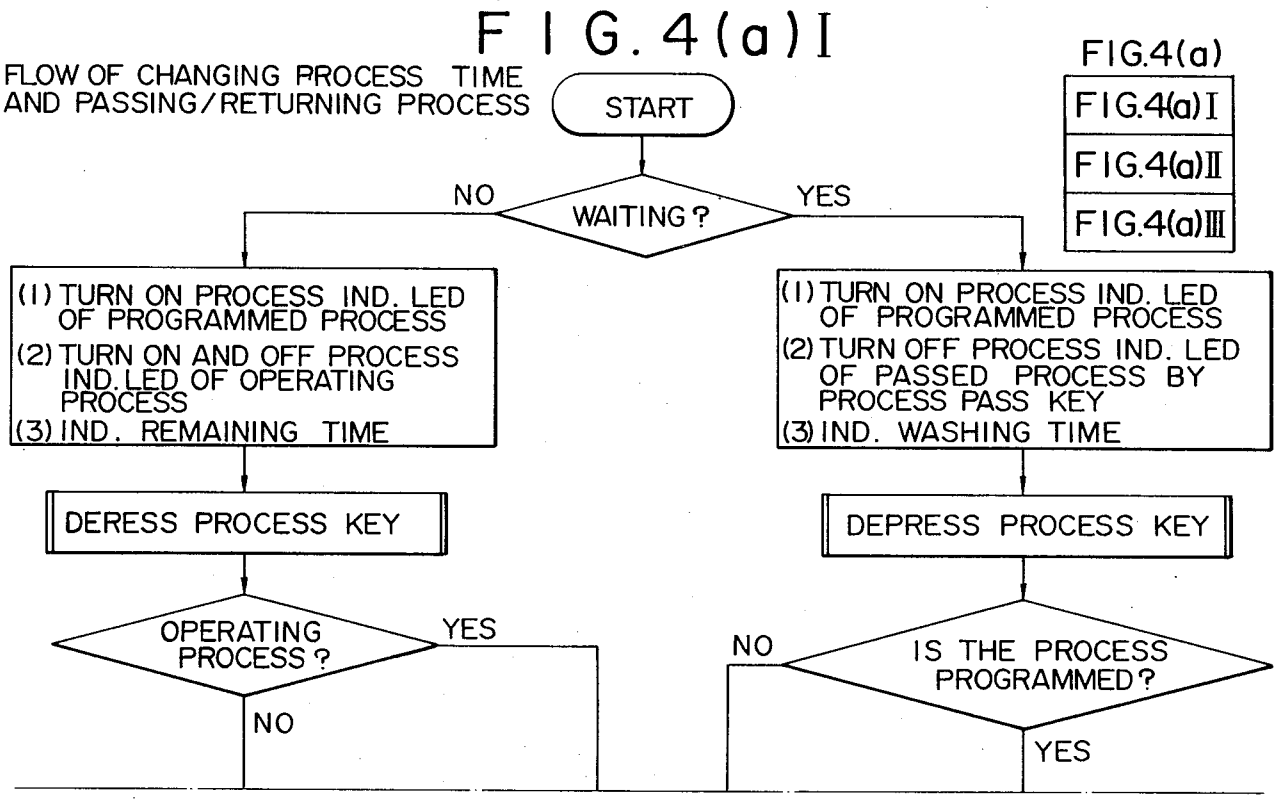
FIG. 4(a) I
FLOW OF CHANGING PROCESS TIME AND PASSING/RETURNING PROCESS FIG. 4 (a) II
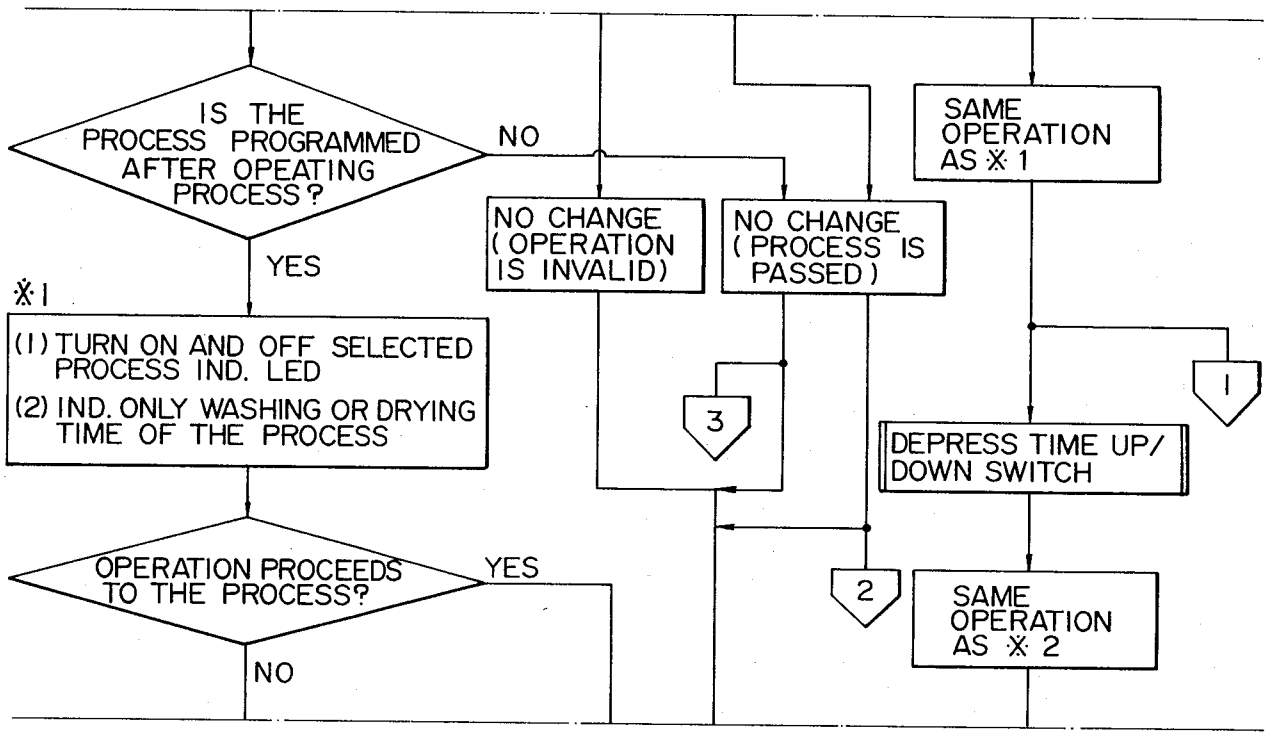

FIG. 4(a) III
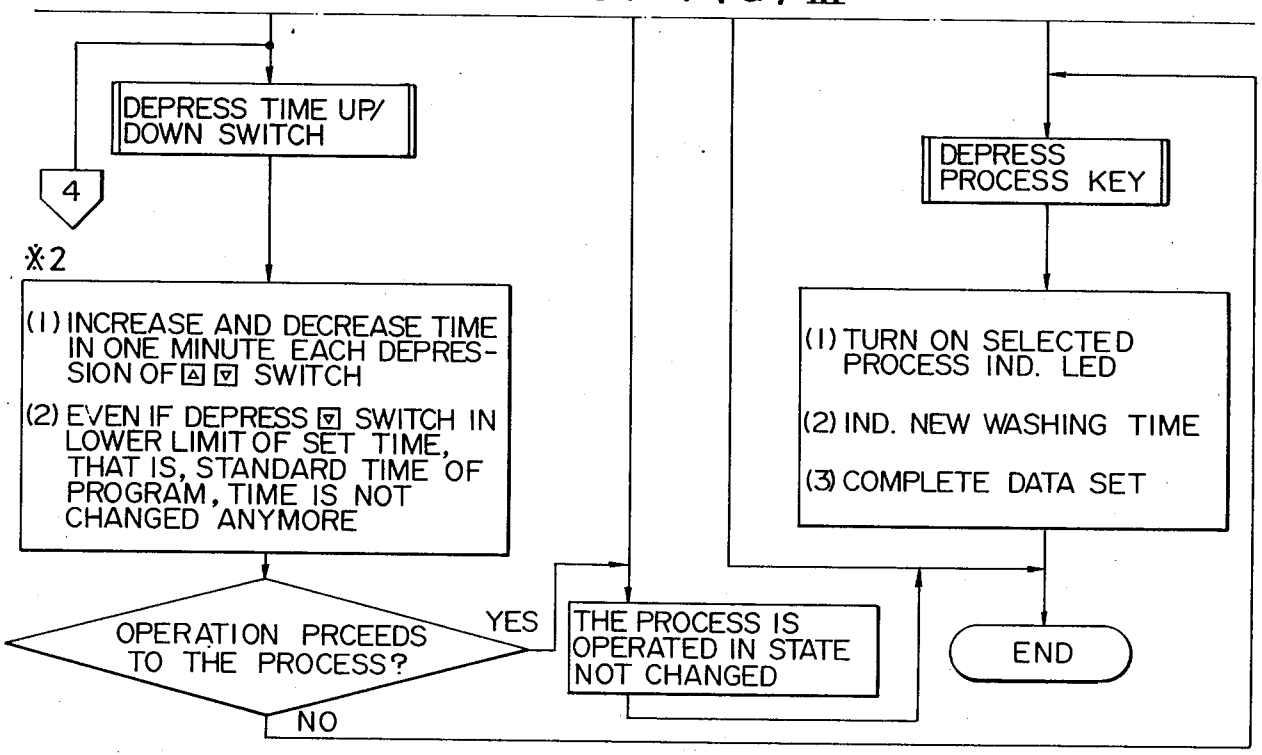

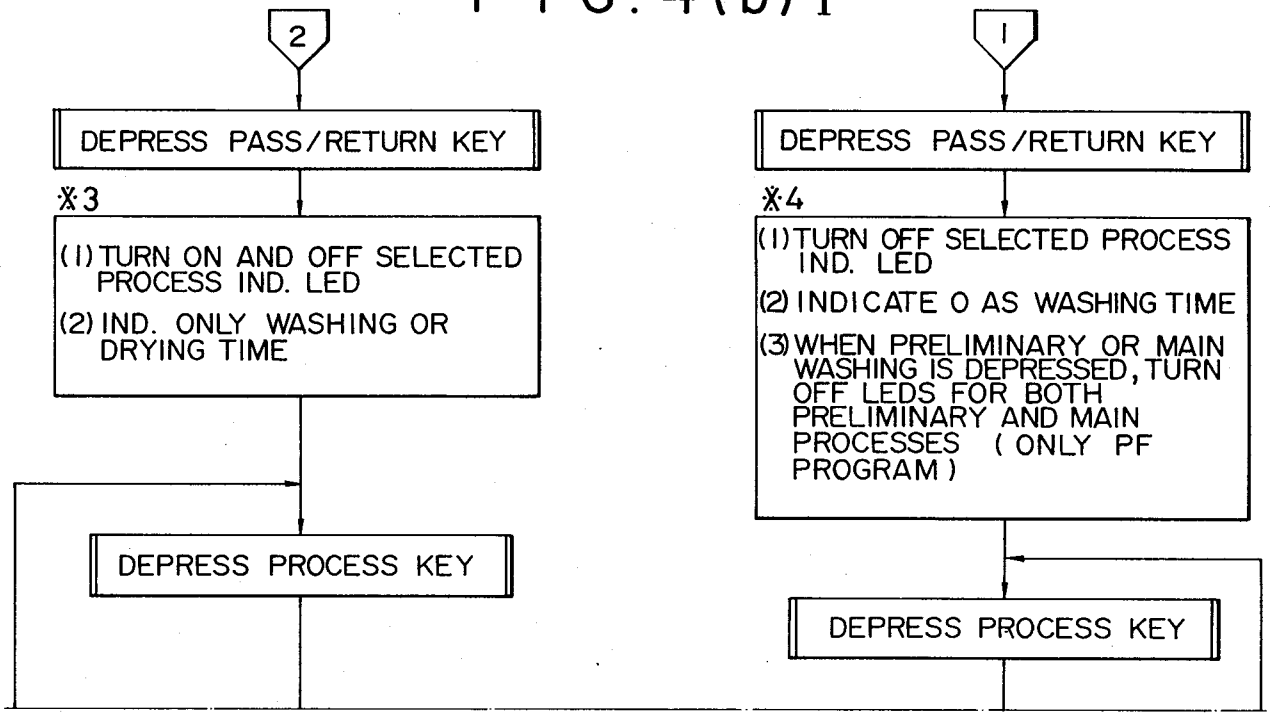
FIG. 4(b) I

FIG. 4(b)II
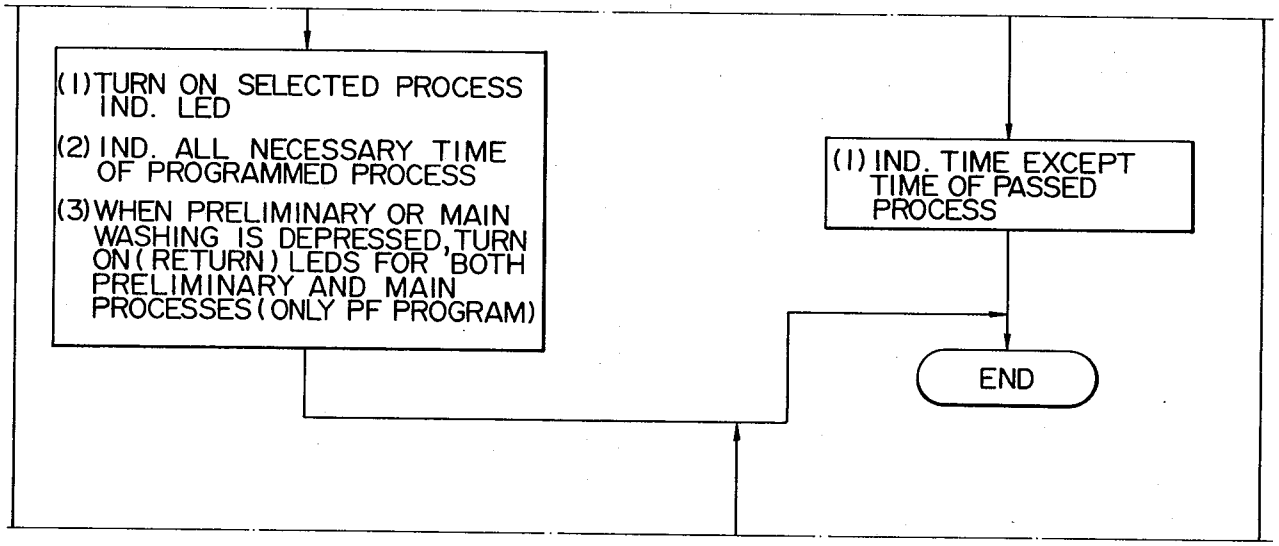

FIG. 4(b) III
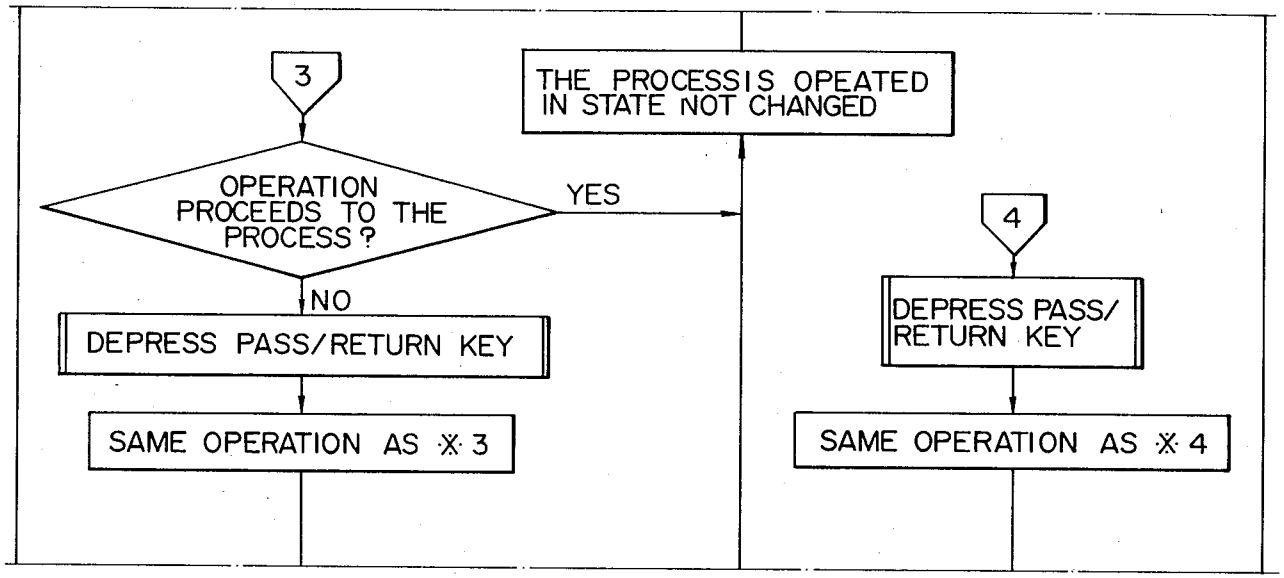

FIG. 4(b)IV

| |
|---|
| FIG.4(b)I |
| FIG.4(b)II |
| FIG.4(b)III |
| FIG.4(b)IV |

FIG. 5(a) I
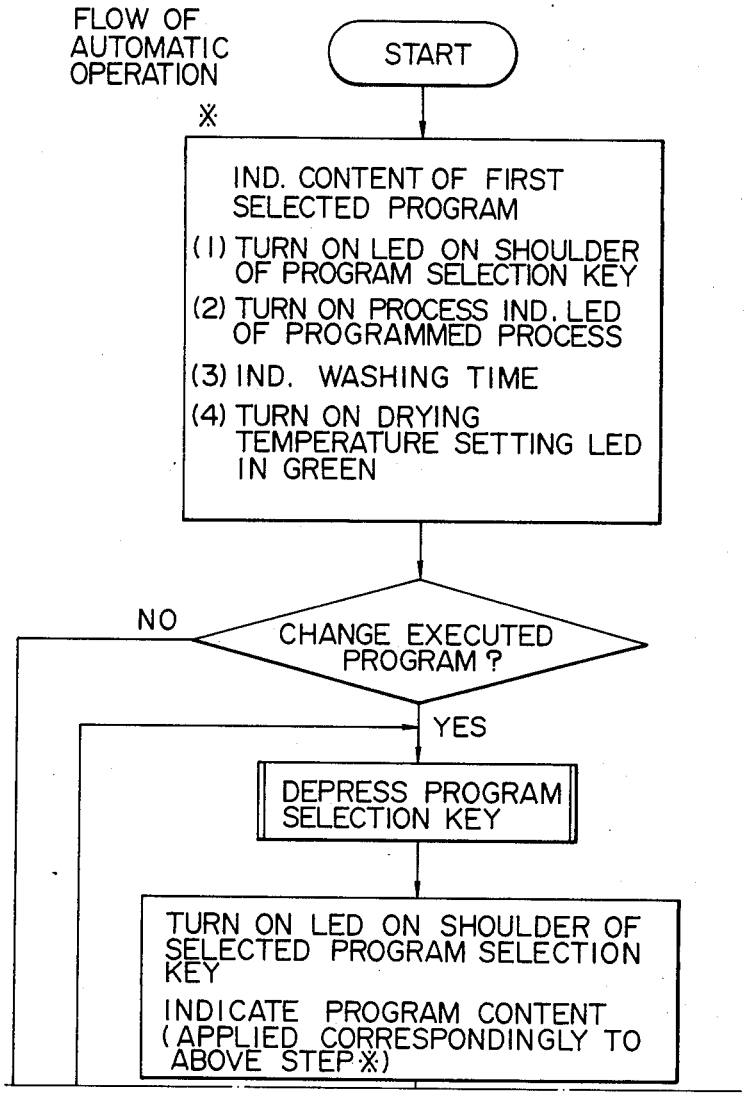

FIG. 5(a)II

| |
|---|
| FIG.5(a)I |
| FIG.5(a)II |

FIG. 5(b) I
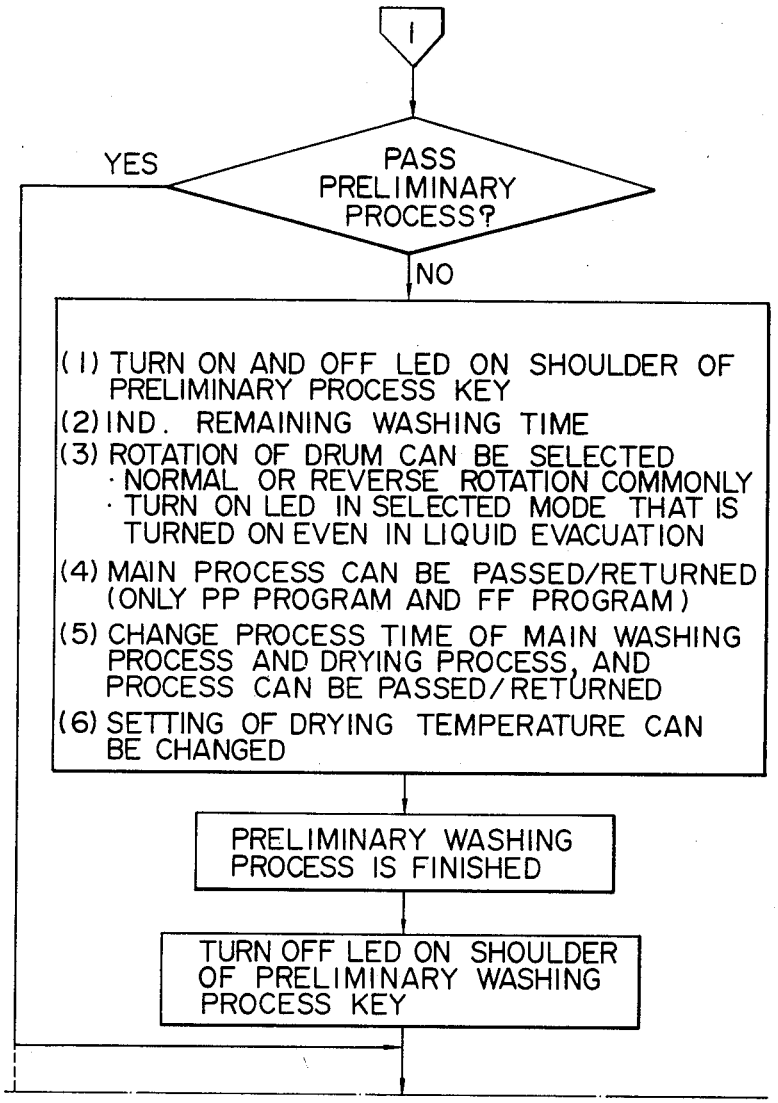

| |
|---|
| FIG.5(b) I |
| FIG.5(b) II |
| FIG.5(b) III |

FIG. 5(b) II

FIG. 5(b) III
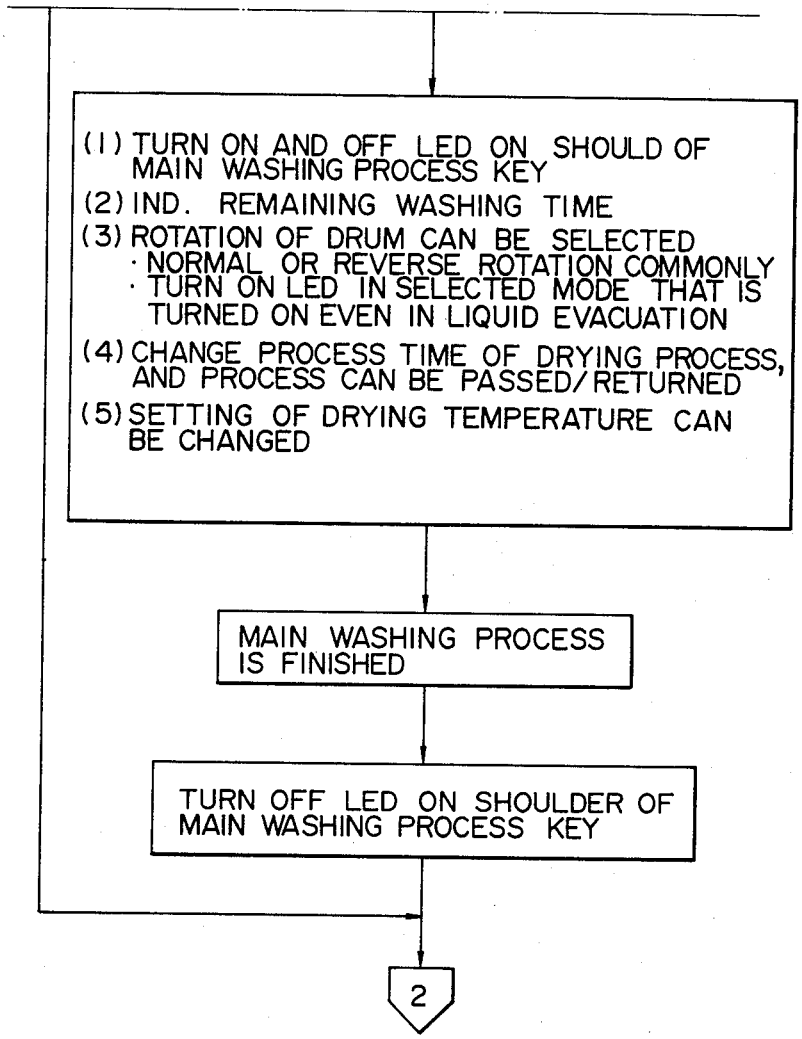

FIG. 5(c) I
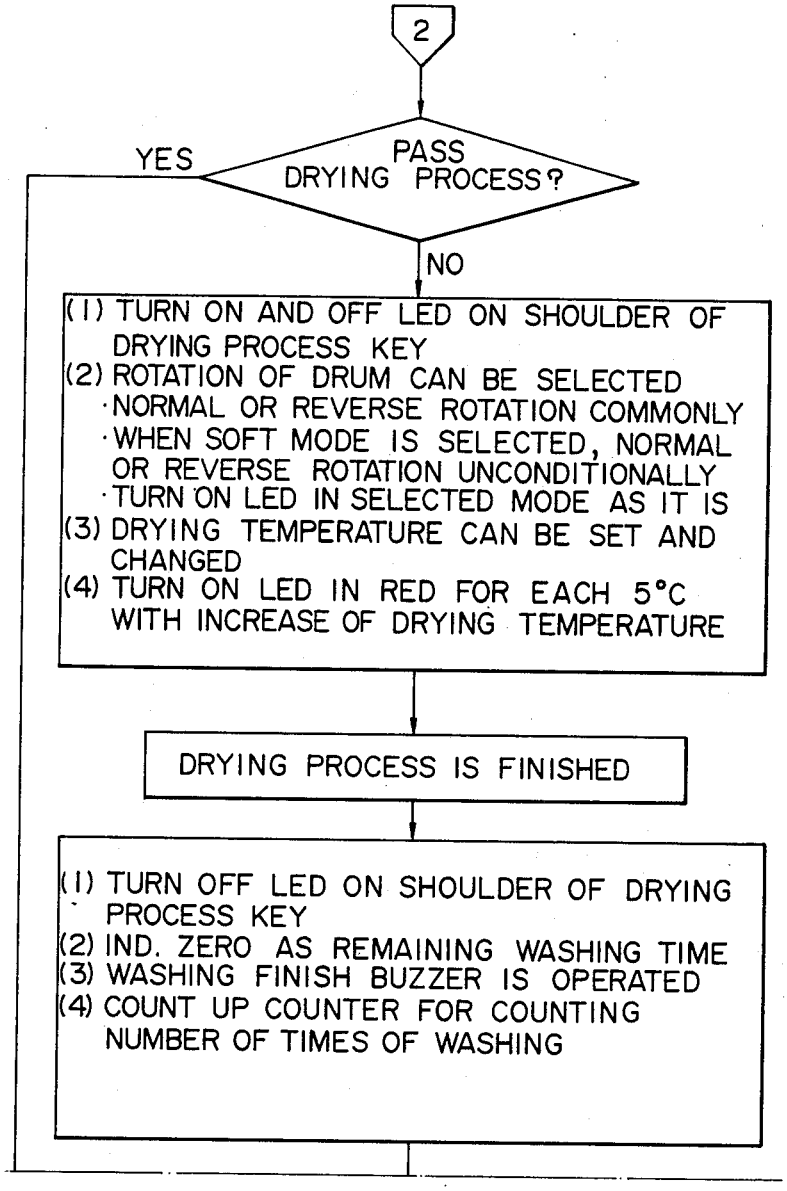

FIG. 5(c) II

| |
|---|
| FIG.5(c) I |
| FIG.5(c) II |

CONTROLLER FOR A DRY CLEANING APPARATUS

FIELD OF THE INVENTION AND RELATED ART STATEMENT

The present invention relates to a controller for a dry cleaning apparatus (hereinafter referred to as a dry cleaner) using organic solvents such as perchloroethylene, 1.1.1 trichloroethane, fleon R113, fleon R11, terpene and the like.

FIG. 6 schematically illustrates a dry cleaner which employs an organic solvent such as perchloroethylene to wash clothes. Clothes 2 are put in the dry cleaner through a door 1 and the door 1 is then closed. When operation of the dry cleaner is started, the cleaner is generally operated in the following sequence.

① A solvent 4 is pumped up from a solvent tank 3 through a valve 5 by a pump 6 so that a necessary amount of solvent 4 is fed into a processing tank 10 through a valve 7 and a filter 8 or through a valve 9.

② A processing drum 11 is slowly rotated by a washing motor 44 and at the same time the solvent 4 is circulated through a circuit consisting of the processing tank 10, a button trap 12, a valve 13, the pump 6, the valve 7 and the filter 8 (hereinafter referred to as a filter circuit) or through a circuit consisting of the processing tank 10, a button trap 12, a valve 13, the pump 6 and the valve 9 (hereinafter referred to as a pump circuit) so that the clothes 2 are washed.

③ The solvent 4 is exhausted through the processing tank 10, the button trap 12, the valve 13, the pump 6, the valve 14 and a distiller 15, and the processing drum 11 is then rotated by a liquid extracting motor 45 at a high speed to centrifugalize the solvent 4 contained in the clothes 2 and exhaust it in the similar route. Thus, the preliminary washing process of the first process is finished.

④ The main washing process of the second process is now made in which the processes ① and ② are repeated.

⑤ The solvent 4 is exhausted through the processing tank 10, the button trap 12, the valve 13 and the valve 5 into the solvent tank 3, and the processing drum 11 is then rotated by the motor 45 at a high speed to centrifugalize the solvent 4 contained in the clothes 2 and exhaust it. Thus, the main washing process is finished.

⑥ The drying process of the third process is now made. The processing drum 11 is slowly rotated by the motor 44 again and air is circulated through a recovery air duct 19 consisting of a fan 16, an air cooler 17 and an air heater 18 and the processing tank 10 in the direction of arrow 20 to dry the clothes 2. Solvent gas evaporated from the clothes 2 is condensed in the air cooler 17 and is fed in a water separator 22 through a withdrawal path 21 to be further fed in a clean tank 24 through a solvent pipe 23.

⑦ When the drying process of the clothes 2 is finished, the final smell removal process is now made. Dampers 25 and 26 are opened as shown by broken line to introduce fresh air from the damper 25. Thus, solvent gas which has not been condensed and withdrawn in the air cooler 17 is exhausted from the damper 26 and smell of the solvent contained in the clothes 2 is removed.

⑧ The solvent 4 entered into the distiller 15 in the process ③ is evaporated and is then condensed in a condenser 27. Further, the condensed solvent is sent out from the condenser 27 through the water separator 22 and the solvent pipe 23 into the clean tank 24 and is then returned to the solvent tank 3 through an overflow partition plate 28. Water separated by the water separator 22 is exhausted outside of the cleaner through a water pipe 29.

The foregoing is an example of the dry cleaning process of the dry cleaner including the washing process, the drying process and the smell removal process. A block diagram of a controller for controlling the above dry cleaning process is shown in FIG. 7 and an example of an operating panel is also shown in FIG. 8.

Numeral 31 denotes a dry cleaner which washes clothes and has the configuration described in the above process by way of example. Numeral 32 denotes an operating panel which operates the dry cleaner 31 and numeral 33 denotes a controller which controls the operation of the dry cleaner 31. The operating panel 32 includes a program selection switch 34 which selects, for example, eight kinds of operation programs (description of which is omitted), process omitting switches **35*a* to 35*d* which are employed when processes in the operation program are omitted, time settings 36*a* to 36*d* which set the operating time of the operation program, a time indicator 37 which indicates a necessary time for operation, indication lamps 39*a* to 39*i* which indicate the operation manner of the washing process and other processes, a start switch 40 which starts the dry cleaner 31, and a temperature controller 41 of liquid expansion type which decides a drying temperature of clothes 2 in the drying process. The temperature controller 41 is provided with a setting indicator 42 which sets the drying temperature, a temperature indicator 43 which indicates the drying temperature, and an electrical switch 46** which is closed when the drying temperature exceeds the set value.

The controller 33 comprises a central processor unit 47 formed of an electronic circuit and which is a center of control of the dry cleaner 31, an electronic memory unit 48 which stores eight kinds of operation programs, and an output circuit 49 which drives predetermined devices in the dry cleaner 31 on the basis of instructions of the central processor unit 47.

The dry cleaner having the controller adopts the washing and drying processes using a single solvent. Clothes 2 are put in the cleaner through the door 1 and a program number is selected by the program selection switch 34 of the operation panel 32. The drying temperature is then set by the setting indicator 42 of the temperature controller 41. When the start switch 40 is depressed, the washing manner is automatically decided and the operation described in the above dry cleaning process by way of example is automatically performed. The utmost that such a controller can make is extension or reduction of the washing time in the process programmed by the time settings **36*a* to 36*d* or elimination of processes programmed by the process omitting switches 35*a* to 35*d***.

Table 1 shows comparison of representative physical properties of solvents which are mainly used at the present time. Table 2 shows comparison of features, limitations, defects and the like in dry cleaning caused by the representative physical properties of the solvents shown in Table 1.

Accordingly, in order to cope with the latest various materials, processing and forms of clothes, three types of dry cleaners using, for example, perchloroethylene, fleon R113 and 1.1.1 trichloroethane, respectively, are required. Consequently, a launderer has very large burden such as increase of purchase funds, space for dry cleaners and facility capacity, complexity of maintenance and the like.

TABLE 1

| | Boiling Point (°C.) | Specific Gravity (g/cc) | KB Value | Burning Point (°C.) |
|---|---|---|---|---|
| 1.1.1 trichloroethane | 74 | 1.35 | 124 | not burn |
| perchloroethylene | 121 | 1.62 | 90 | not burn |
| fleon R113 | 47.5 | 1.58 | 31 | not burn |
| terpene (petroleum group) | 150–200 | 0.8 | 31 | 38 |

In Table 1, the KB value is one of a measure representative of relative solubility of the solvent.

TABLE 2

| | Features | Limitations Defects | Others |
|---|---|---|---|
| 1.1.1 trichloroethane | Large solubility and washing power. Hardly contaminated. Relatively low boiling point. Suitable for men's suit and wool knit. Low temperature drying. | Unsuitable for urethane processed goods, adhesive material, recent delicate clothes, pigment, charcoal print, particular resin, rubber. Main part of apparatus formed of stainless. | Somewhat difficult to withdraw activated (stability of withdrawn solvent has problem). Market is sharply grown last some years |
| perchloroethylene | Solubility and washing power are large next to 1.1.1 trichloroethane. High boiling point next to terpene. Suitable for men's suit and wool knit. | Substantially same as above. Slightly high drying temp. Material weak for heat needs caution. | Synthetic solvent is most spread. Main part of apparatus can be formed of plated iron. |
| fleon R113 | Small solubility and washing power. Low boiling point. Capable of dealing with most of material for clothes (suitable for delicate clothes). Low temperature and short time drying. | Difficult to remove dirt due to low washing power. Solvent withdrawal technique of freeing type or using activated charcoal is required. Main part of apparatus is formed of stainless. | Solvent is most expensive. Market is slowly grown. |
| terpene (petroleum) | Solubility and washing power are small. Capable of dealing with most of material for clothes. | Highest boiling point and inflammability. Difficult to remove dirt. Difficult to control solvent. Long washing and drying time. | Cheapest solvent but large loss. Delicate clothes must be dried with wind. Main part of apparatus can be formed of plated iron. |

OBJECT AND SUMMARY OF THE INVENTION

The present invention has been made to solve the above problems, and an object of the present invention is to provide a controller for a dry cleaning apparatus capable of using two or more types of solvents separately or in combination to treat all of various clothes.

It is another object of the present invention to provide a controller for a dry cleaning apparatus capable of selecting a best washing method in accordance with materials, processing and forms of clothes.

In order to achieve the above objects, the structure of the present invention is as follows.

The dry cleaner of the present invention including a processing tank, tanks capable of containing two or more types of solvents, respectively, capable of melting to be mixed with each other, for example, perchloroethylene and fleon R113, respectively, a fractionating device for fractionating two or more types of solvents to withdraw the solvents and filters for the respective solvents, comprises a washing program for a single solvent, for example only perchloroethylene or fleon R113, which is previously stored in a central processing unit which is formed of an electronic circuit and is a center of control of the apparatus, and a washing program for washing with combined solvents in which washing is first made with perchloroethylene and subsequently washing is made with fleon R113 and which is previously stored in the central processing unit, thereby to treat various material, processing and forms of clothes.

More particularly, the controller for the dry cleaning apparatus comprises:

(a) a memory circuit which previously stores washing programs for washing clothes with a single solvent or combined solvents;

(b) an operation panel for selecting the washing programs;

(c) an input circuit to which a signal from a sensor for detecting an amount of the solvent pumped up in the processing tank is inputted;

(d) an output circuit for driving motors which rotate the processing tank, a pump for pumping up the solvents and for circulating the solvents, and a plurality of valves disposed between portions forming the dry cleaner; and (e) a CPU (central processor unit) for processing a program selection signal from the operation panel, a program signal from the memory circuit and an input signal from the input circuit and producing the resultant signal to supply it to the output circuit, whereby an optimum washing method can be selected in accordance with material, processing and forms of clothes.

According to the present invention, the following various excellent effects are attained.

(1) Since two or more types of solvents can be employed separately or in combination in one dry cleaner, an optimum washing method can be selected in accordance with material, processing and forms of almost all clothes. Accordingly, damage for clothes in washing can be greatly reduced. In addition, large merits are obtained in various aspects such as reduction of space and funds, capacity of facilities and maintenance.

(2) If a PF program and an FF program are employed, the drying time can be reduced greatly and an adverse influence to clothes due to tumbling can be reduced.

DETAILED DESCRIPTION OF A PREFERRED EMBODIMENT

Figure 1:
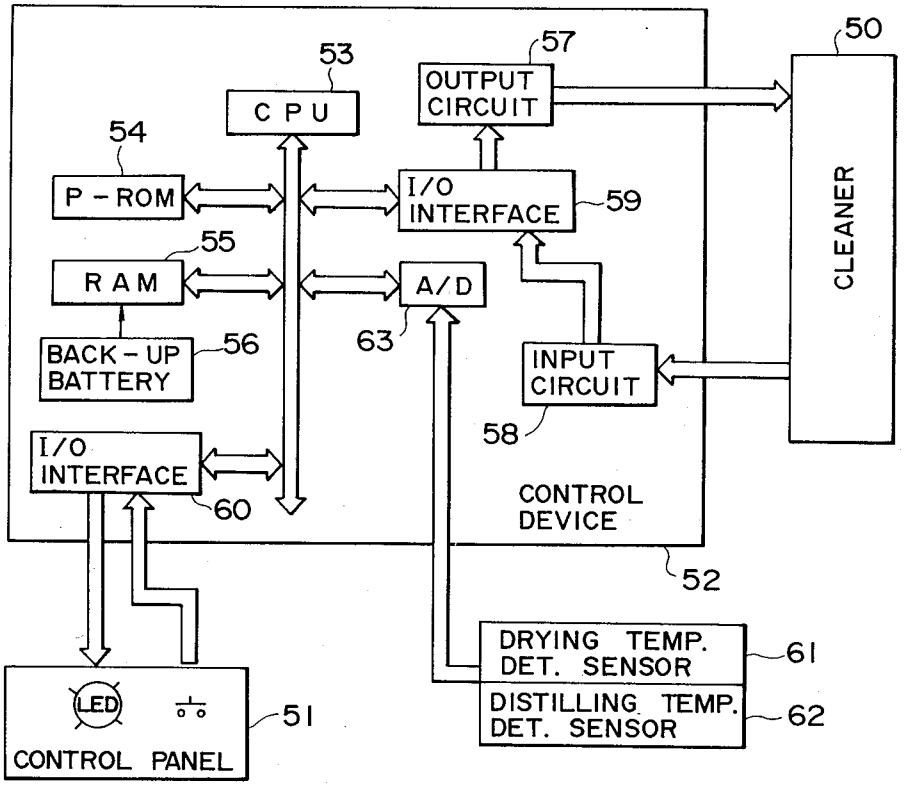
FIG. 1 is a control block diagram showing an configuration of an embodiment of the present invention.
Figure 2:
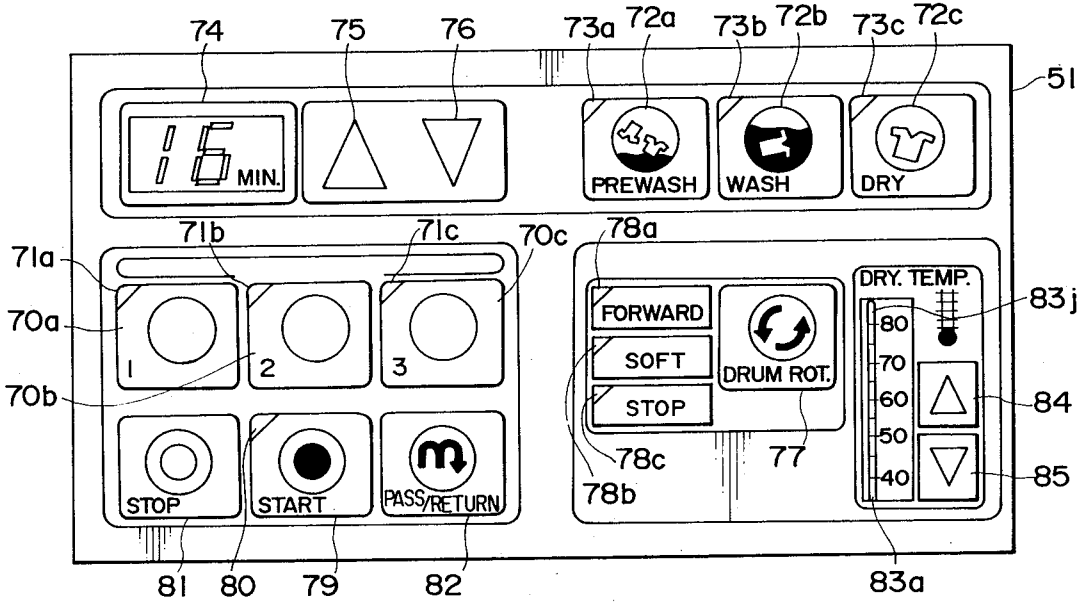
FIG. 2 illustrates an example of a control panel for use in the apparatus of FIG. 1.
Figure 3:
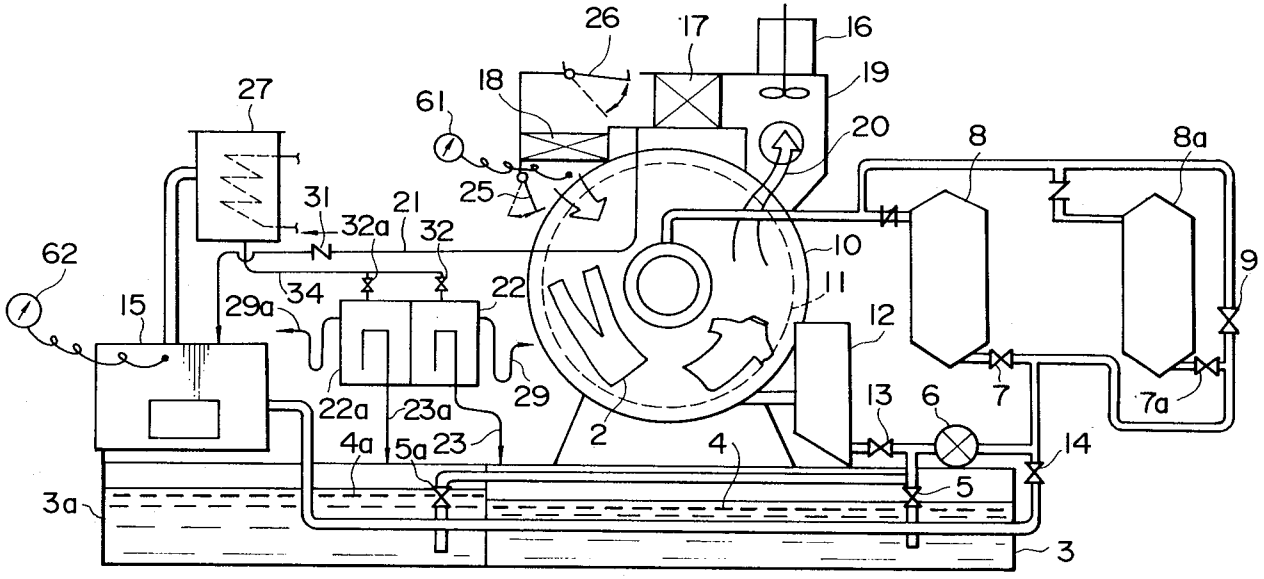
FIG. 3 is a system diagram of a cleaning apparatus showing an embodiment of the present invention.
Figure 4B:
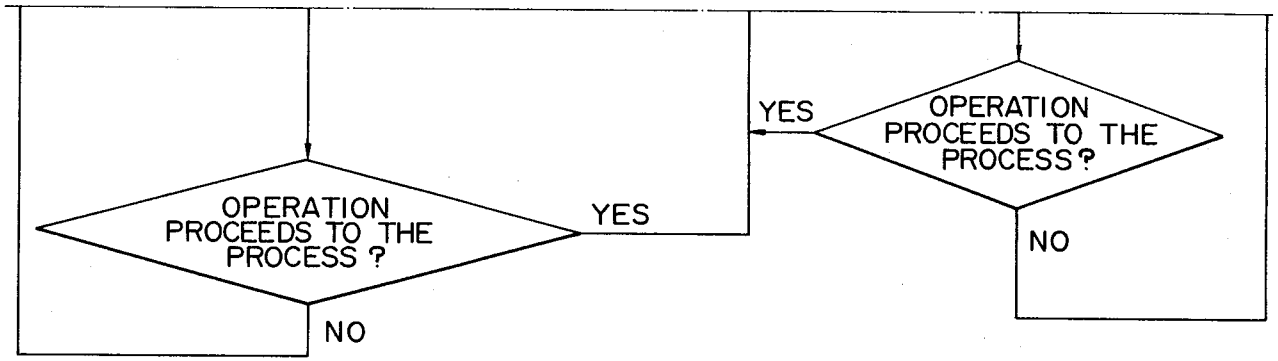
FIGS. 4 (A) and (B) are flowcharts showing change of the process time and process pass/return operation by the operation panel.
Figure 5A:
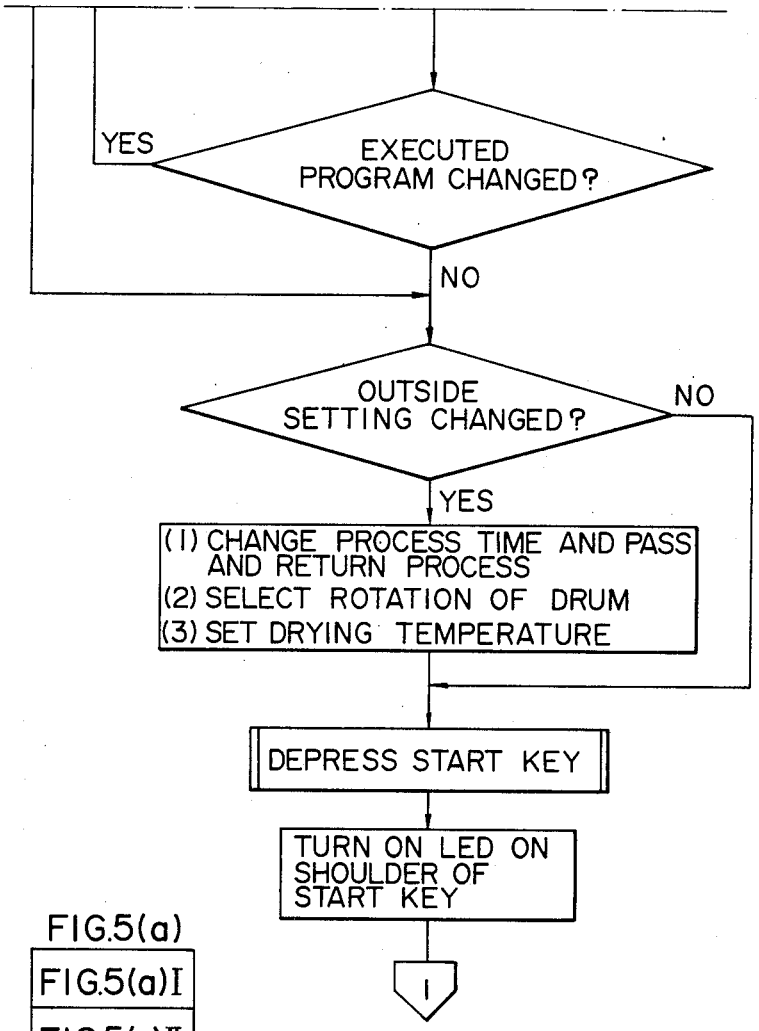
FIGS. 5 (A), (B) and (C) are flowcharts showing automatic operation.
Figure 5B:
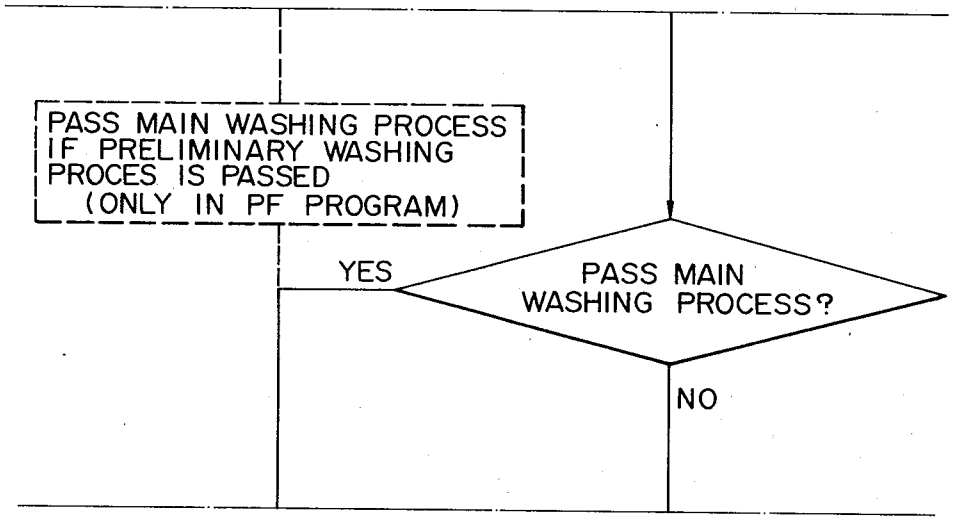
Figure 5C:
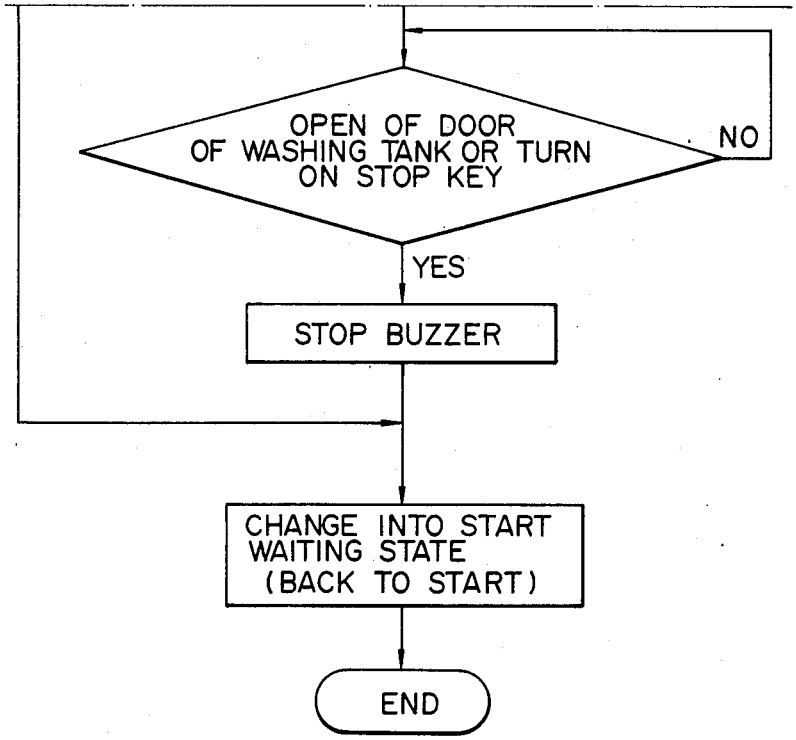

FIG. 1 is a control block diagram showing a configuration of an embodiment of the present invention, FIG. 2 shows an example of a control panel in FIG. 1, FIG. 3 shows an example of a structure of a cleaning apparatus of FIG. 1, FIGS. 4 (A) and (B) are flowcharts showing change of the process time and process pass/return operation by the operation panel of FIG. 2, and FIGS. 5 (A), (B) and (C) are flowcharts of automatic operation.

Figure 6:
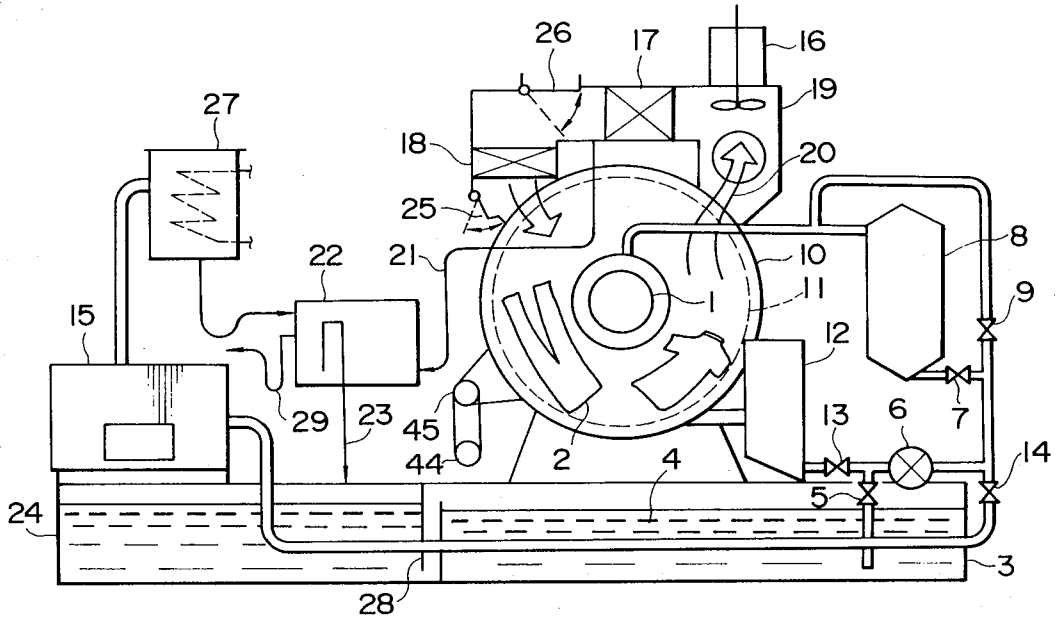
FIG. 6 (PRIOR ART)
FIG. 6 is a system diagram of a conventional cleaning apparatus.
Figure 7:
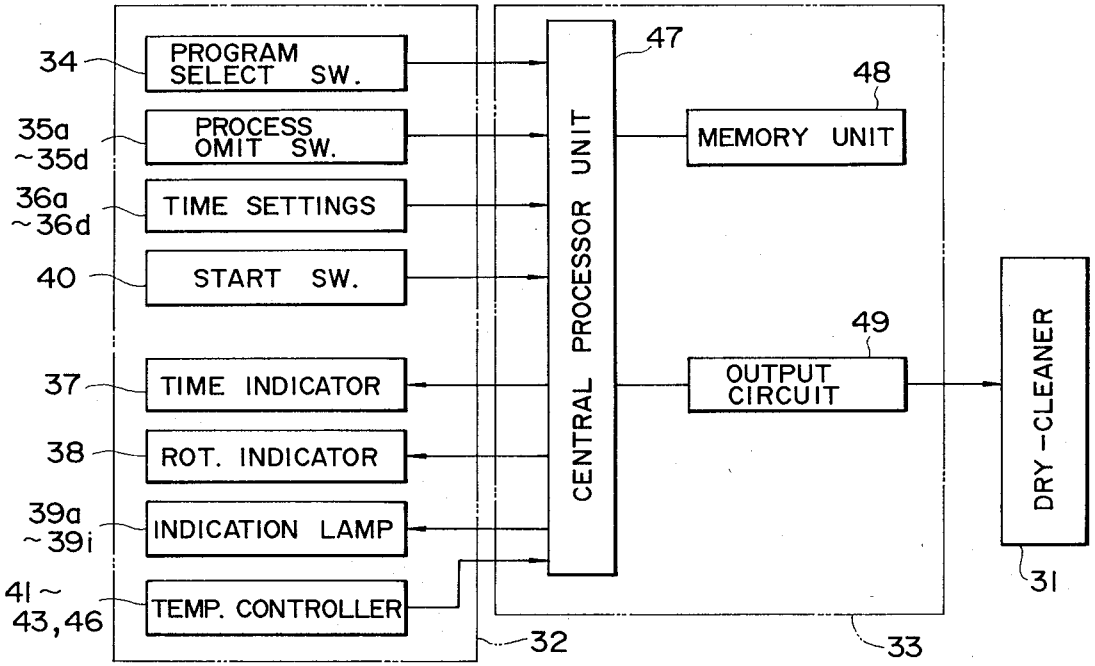
FIG. 7 (PRIOR ART)
FIG. 7 is a control block diagram explaining the conventional cleaning apparatus.
Figure 8:
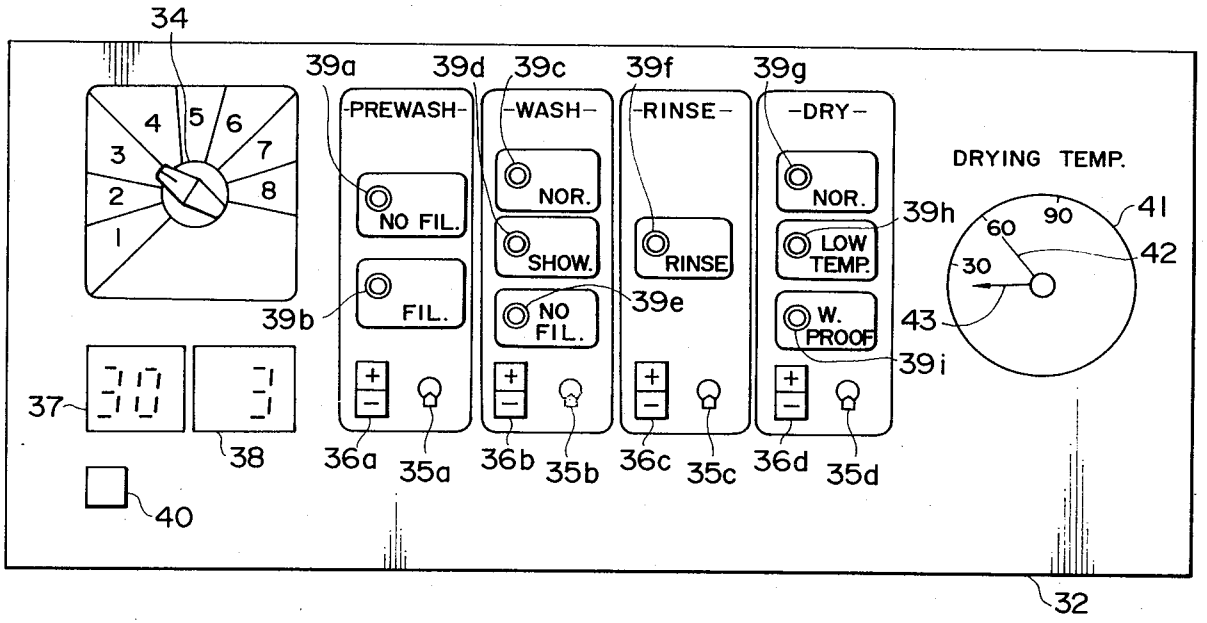
FIG. 8 (PRIOR ART)
FIG. 8 shows a conventional operation panel.

Numeral 50 denotes a cleaning apparatus including valves and motors for washing clothes. The cleaning apparatus is mainly different from the conventional apparatus of FIG. 6 in that a first solvent containing tank 3 and a second solvent containing tank 3a are independently provided which are further provided with valves 5 and 5a, respectively, and a first solvent filter 8 and a second solvent filter 8a are separately provided which are further provided with valves 7 and 7a, respectively. There are further provided water separators 22 and 22a which can be properly employed by program control in addition to control by the inherent boiling point of the solvent. Valves 32, 32a, solvent pipes 23, 23a and water pipes 29, 29a are further disposed in a condensed solvent flowing pipe 34 in accordance with the water separators 22 and 22a.

A withdrawal path 21 connected to an air cooler 17 is coupled with a distiller 15 through a check valve 31. Other structure is substantially identical with that of FIG. 6.

Numeral 51 denotes a control panel for controlling the cleaning apparatus 50 which is disposed in a front panel of the apparatus, and numeral 52 denotes a control device which controls operation of the cleaning apparatus 51 and is provided within the apparatus 50.

The control panel 51 comprises first to third program selection keys 70a to 70c which select operation programs (for simplification of description, three program selection keys are provided), light emitting diodes (hereinafter referred to as LED) 71a to 71c which are disposed in left shoulders of the corresponding keys, respectively, to indicate the selected key, process keys 72a to 72c provided corresponding to a preliminary washing process to a drying process, respectively, process indication LEDs 73a to 73c, a time indicator 74 which indicates a necessary time for washing, a time increasing key and a time decreasing key which set a process time by one minute, a drum rotation selection key 77 which establishes a rotational manner of the processing drum 11 of the cleaning apparatus 50, rotational manner indication LEDs 78a to 78c which indicate the set status of the rotational manner of the processing drum 11, a start key 79 which starts the cleaning apparatus 50, an LED 80 which indicates the depression of the start key 79, a stop key 81 which stops operation of the apparatus, a pass/return key 82 for passing and returning the programmed process, two green and red LEDs 83a to 83j which indicate a set value of the drying temperature and an actually measured value thereof, and an up key 84 and a down key 85 which increase and decrease the set temperature, respectively.

The control device 52 comprises a central processor unit (CPU) 53 which is a center of control of the cleaning apparatus 50, a programmable read only memory (PROM) 54 which stores washing programs and control sequences, a random access memory (RAM) 55 which temporarily stores data necessary for control, a battery 56 which backs up the RAM 55 since the memory content of the RAM 55 disappears when a power supply for the RAM 55 is turned off, an output circuit 57 which drives valves and motors of the cleaning apparatus 50, an input circuit 58 which is supplied with a signal from a sensor such as a liquid level switch (not shown) which detects an amount of pumping up the solvent in the cleaning apparatus 50, an I/O interface 59 through which transmission and reception of signals between the output circuit 57 and the input circuit 58 and the CPU 53 are made, and a panel control I/O interface 60 through which transmission and reception of signals between the control panel 51 and the CPU 53 are made. There is provided an A/D converter which converts analog signals detected by a drying temperature detection sensor 61 attached to the recovery air duct 19 of the cleaning apparatus shown in Fig. 3 and a distillatory temperature detection sensor 62 attached to the distiller 15 into digital signals to supply the digital signals to the CPU 53.

Operation is now described.

(1) In FIG. 3, it is assumed that a first solvent 4 is a low boiling solvent (hereinafter referred to as fluorine) and a second solvent 4a is a high boiling solvent (perchloroethylene). The washing programs are previously stored in the PROM 54 of the control device 52. For example, a program (PP program) for preliminarily and mainly washing usual black clothes with perchloroethylene is stored in the memory area of the PROM 54 corresponding to the first program selection key 70a, a program (PF program) for preliminarily washing, for example, usual white clothes with perchloroethylene and mainly washing them with fluorine is stored in the area of the PROM 54 corresponding to the second program selection key 70b, and a program (FF program) for preliminarily and mainly washing, for example, knitted clothes with fluorine is stored in the area of the PROM 54 corresponding to the third program selection key 70c.

When the first program selection key 70a is selected, the selected signal is transmitted through the I/O interface 60 to the CPU 53 to read out the memory contents stored in the PROM 54 corresponding to the first program selection key 70a. The information read out from the PROM 54 is further transmitted through the I/O interface 60 to the control panel 51. Consequently, the LED 71a of the first program selection key 70a in the control panel 51 is turned on and the time indicator 74 indicates a necessary time for washing. Further, the process indication LEDs 73*a* to 73*c* are also turned on. The drying temperature is set to a predetermined temperature by an up key 84 and a down key 85. The temperature can be set and indicated in 5° C. When the temperature of 80° C., for example, is set by the up key 84, the temperature information is transmitted through the I/O interface 60 to the CPU 53 so the CPU 53 stores the temperature set condition in the RAM 55 on the basis of a command of the PROM 54. At the same time, the CPU 53 turns on the temperature indication LEDs 83*a* to 83*j* through the interface 60 so that green light in the form of bar graph is extended to 80° C.

The PROM 54 stores the rotational information of the drum as "normal and reverse rotation" (for example, repeat of normal rotation for 25 seconds, stop for 5 seconds and reverse rotation for 25 seconds). However, the rotation of the drum can be changed by depressing the drum rotation selection key 77. When the drum rotation selection key 77 is once depressed, the drum rotates in one direction of normal rotation. When the key 77 is depressed once more, the drum is softly rotated in the repeated manner of normal rotation for 2 seconds, stop for 13 seconds and reverse rotation for 2 seconds so that the rotation of the drum does not damage clothes except the drying process. In the drying process, the drum rotates in the standard normal and reverse rotation unconditionally. When the key 77 is further depressed, the drum is stopped except the liquid extraction process.

When the key is further depressed, the rotation of the drum rotates in the standard normal and reverse rotation. The transmission and reception of the signals for rotation are made in the same manner as in the drying temperature setting and the selected one of the LEDs 78 is turned on.

(2) The preparatory operation for start is completed in the above manner. When the start key 79 is then depressed, the LED 80 in the left shoulder of the start key 79 is turned on to indicate the operation condition. The CPU 53 sends out a signal through the I/O interface 59 to the output circuit 57 to start the cleaning apparatus 50. The flowchart of the automatic operation is shown in FIG. 5. When operation of the cleaning apparatus 50 begins, the indication of the time indicator 74 in the control panel 51 is reduced every one minute to indicate the remaining washing time and at the same time the process indication LED 73 corresponding to the process in operation is turned on and off. When the process is finished, the process indication LED is turned off and another LED 73 corresponding to the next process is turned on and off. The above operation is controlled by the CPU 53 through the I/O interface 60.

When the process indication LED 73*c* for the drying process is turned on and off, air is circulated between the processing tank 10 and the recovery air duct 19 consisting of the fan 16, the air cooler 17 and the air heater 18 of FIG. 3 in the direction of arrow 20 by the fan 16 to dry clothes 2. The air heater 18 is to heat the circulated air. The temperature of air heated by the air heater 18 is detected by the drying temperature detection sensor 61 attached to the recovery air duct 19 to control the air heater so that the temperature is maintained constant. When the sensor detects the temperature, the sensor produces an analog signal proportional to the temperature and the signal is converted by the A/D converter 53 into a digital signal which is supplied to the CPU 53. The digital signal supplied to the CPU 53 is compared with the temperature set value stored in the RAM 55 under the command of the PROM 54 to control the air heater 18. At the same time, in order to indicate the actually measured drying temperature in the control panel through the I/O interface 60, the green light of the temperature indication LEDs 83 corresponding to the set temperature is turned off and the red light corresponding to the measured temperature is turned on.

Accordingly, the temperature indication LEDs 83 in the form of bar graph indicates the actually measured temperature in red and the remaining part of the set temperature in green. Since the RAM 55 is backed up by the battery 56, even if the power supply is turned off during operation, the depressed conditions of the program selection key 70 and the drum rotation key 77, the progress of the program, the set condition of the drying temperature and the like are all stored. Accordingly, when the power supply is turned on, operation can be continued as it is only by depressing the start key 79.

(3) Operation of the cleaning apparatus 50 at the time when the first program selection key 70*a* is selected is now described in detail.

① The solvent 4*a* of perchloroethylene is pumped up from the tank 3*a* through the valve 5*a* by the pump 6 and a necessary amount of solvent 4*a* is fed to the processing tank 10 through the valve 7*a* and the filter 8*a* or through the valve 9.

② The processing drum 11 is slowly rotated by the motor 44 to circulate the solvent 4*a* of perchloroethylene through a circuit (hereinafter referred to as a perchloroethylene filter circuit) consisting of the processing tank 10, the button trap 12, the valve 13, the pump 6, the valve 7*a* and the filter 8*a* or a circuit (hereinafter referred to as a pump circuit) consisting of the processing tank 10, the button trap 12, the valve 13, the pump 6 and the valve 9 to thereby wash clothes 2.

③ The solvent is exhausted through the processing tank 10, the button trap 12, the valve 13, the pump 6, the valve 14, the distiller 15 and the processing drum 11 is rotated at a high speed by the motor 45 to centrifugalize the solvent 4*a* of perchloroethylene contained in clothes 2 and exhaust it. Thus, the preliminary washing operation is finished.

④ The main washing process is now made in which the above processes ① and ② are repeated.

⑤ The solvent is exhausted in the solvent tank 3*a* through the processing tank 10, the button trap 12, the valve 13 and the valve 5*a* and the processing drum 11 is then rotated at a high speed by the motor 45 to centrifugalize the solvent 4*a* contained in clothes 2 and exhaust it. Thus, the main washing operation is finished.

⑥ The drying process is now made in which the processing drum 11 is slowly rotated again by the motor 44 and air is circulated between the processing tank 10 and the recovery air duct 19 consisting of the fan 16, the air cooler 17 and the air heater 18 in the direction of arrow 20 to dry clothes 2. The solvent gas evaporated from clothes 2 is condensed in the air cooler 17 and is fed to the distiller 15 through the withdrawal path 21 and the check valve 31.

⑦ When the drying process is finished, the dampers 25 and 26 are opened as shown by broken line to take in fresh air from the damper 25 and exhaust the solvent gas which could not be withdrawn and condensed in the air cooler 17 from the damper 26 so that smell of the solvent contained in clothes 2 is removed.

⑧ The solvent 4a of perchloroethylene sent in the distiller 15 in the process ③ is evaporated and condensed in the condenser 27 to flow into the water separator 22a through a valve 32a controlled by the distillatory temperature detection sensor 62 attached to the distiller 15 and be returned to the solvent tank 3a through solvent pipe 23a.

The distillatory temperature detection sensor 62 attached to the distiller 15 detects a temperature of the evaporated solvent gas. When the detected temperature is less than, for example, 70° C., the CPU 53 controls so that the valve 32 for the low boiling solvent is opened to introduce the condensed solvent into the water separator 22, while when the temperature is more than, for example, 70° C., the valve 32a for the high boiling solvent is opened to introduce the condensed solvent into the water separator 22a.

(4) When the third program selection key 70c is selected, the FF program is executed. Accordingly, operation is the same as the above operation except that the solvent tank 3, the solvent 4 of fluorine, the valve 5, the filter 8 (fluorine filter circuit), the valve 7, the valve 32, the water separator 22 and the solvent pipe 23 are employed instead of the solvent tank 3a, the solvent 4a of perchloroethylene, the valve 5a, the filter 8a, the valve 7a, the valve 32a, the water separator 22a and the solvent pipe 23a in the above descriptions ① to ⑤ and ⑧.

(5) When the second program selection key 70b is selected, the PF program is executed. Operation thereof is now described.

(a) The same operation as that in the above description (3)-① (pumping up of the solvent in the preliminary washing process).

(b) The same operation as that in the above description (3)-② (preliminary washing process).

(c) The same operation as that in the above description (3)-③ (exhausting of the solvent in the preliminary washing process).

(d) The solvent 4 of fluorine is pumped up from the solvent tank 3 through the valve 5 by the pump 5 and a necessary amount of the fluorine solvent 4 is fed to the processing tank 10 thorugh the valve 7 and the filter 8 or through the valve 9.

(e) The processing drum 11 is slowly rotated by the motor 44 so that the solvent 4 of fluorine is circulated through a circuit (hereinafter referred to as a fluorine filter circuit) consisting of the processing tank 10, the button trap 12, the valve 13, the pump 6, the valve 7 and the filter 8 or through a pump circuit consisting of the processing tank 10, the button trap 12, the valve 13, the pump 6 and valve 9 to wash clothes 2.

(f) The solvent is exhausted through the processing tank 10, the button trap 12, the valve 13, the pump 6, the valve 14 and the distiller 15. Subsequently, the processing drum 11 is rotated at a high speed to centrifugalize the solvent 4 of fluorine contained in clothes 2 and exhaust it. Thus, the main washing is finished.

(g) The same operation as that in the above description (3)-⑥ (drying process).

(h) The same operation as that in the above description (3)-⑦ (smell removing process).

(i) The solvent 4 of fluorine having the low boiling point of the mixed solvent (4+4a) introduced into the distiller 15 in the processes (c), (f) and (g) is first evaporated and is introduced into the water separator 22 through the condenser 27 and the valve 32 which is controlled by the sensor 62. The solvent introduced into the separator 22 is then returned to the tank 3 through the solvent pipe 23. When the solvent 4 of fluorine in the distiller 15 is reduced, evaporation of the solvent 4a of perchloroethylene having high boiling point begins gradually. The evaporated solvent 4a is introduced into water separator 22a through the condenser 27 and the valve 32a controlled by the sensor 62 and is then returned to the tank 3a through the solvent pipe 23a.

The washing program stored in the PROM 54 can perform extension and reduction of the washing time and elimination of the processes in the same manner as in the prior art. FIG. 4 shows operation for change of the processing time and pass/return of the processes and description thereof is accordingly omitted. Basically, the process key 72 is first depressed to start the apparatus and subsequently the time increasing key 75, the time decreasing key 76 or the process pass/return key 82 is depressed to perform a desired operation. Thereafter, further depression of the process key 72 changes the contents of the washing program. The information concerning the above operation is supplied to the CPU 53 through the I/O interface 60 and is stored in the RAM 55. The modification of the process pass/return operation is cleared when other program selection key 70 is depressed and the process is returned to the washing program stored in the PROM 54. The modification of the process time is stored in the RAM 55 as it is for each program.

The washing program (PF program) corresponding to the second program selection key 70b is to solve the problems such as napping and shrinkage of clothes due to the long drying and accordingly the pass/return operation for only the preliminary washing process or the main washing process can not be made. The above description has been made to the combination of two types of solvents, while three or more types of solvents are also treated in the same manner.

According to the present invention, the following effects are attained:

(1) One dry cleaner can treat various materials, processing and forms of clothes.

(2) The washing program using combined solvents can be employed to reduce the drying time and solve the problems such as napping and shrinkage due to the long drying since clothes are washed with the solvent having low boiling point before the drying.

We claim:

1. A controller for a dry cleaning apparatus including one processing tank, tanks capable of exclusively containing two or more types of solvents, respectively, capable of melting to be mixed with each other, a fractionating device for fractionating two or more types of solvents and filters for the respective solvents, comprising:

a memory circuit for storing washing programs for washing with a single solvent and combined solvents;

a control panel for selecting said washing programs;

an input circuit to which a signal from a sensor which detects an amount of the solvent pumped up into the processing tank is supplied;

an output circuit for driving motors for rotating the processing tank, a pump for pumping up or circulating the solvent and a plurality of valves disposed between portions forming the dry cleaning apparatus; and a CPU (central processor unit) for operating a program selection signal from said control panel, a program signal from said memory circuit and an input signal from said input circuit to supply the operated signal to said output circuit;

whereby an optimum washing method can be selected in accordance with material, processing and form of clothes.

* * * * *